US007812538B2

(12) United States Patent
Moon et al.

(10) Patent No.: US 7,812,538 B2
(45) Date of Patent: Oct. 12, 2010

(54) DIELECTRIC SHEET, PLASMA DISPLAY PANEL USING THE SAME, AND MANUFACTURING METHOD THEREFOR

(75) Inventors: Won Seok Moon, Seoul (KR); Byung Hwa Seo, Seoul (KR); Bo Hyun Kim, Gyeonggi-do (KR); Won Seok Jeon, Gyeonggi-do (KR); Je Seok Kim, Gyeonggi-do (KR); Byung Gil Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 1131 days.

(21) Appl. No.: 11/482,196

(22) Filed: Jul. 7, 2006

(65) Prior Publication Data

US 2007/0013311 A1 Jan. 18, 2007

(30) Foreign Application Priority Data

Jul. 8, 2005 (KR) ..... 10-2005-0061739
Aug. 9, 2005 (KR) ..... 10-2005-0072873
Dec. 30, 2005 (KR) ..... 10-2005-0135571

(51) Int. Cl.
*G09G 3/28* (2006.01)
*H01J 17/49* (2006.01)
*H01J 9/24* (2006.01)

(52) U.S. Cl. ..... 313/586; 345/60; 445/24

(58) Field of Classification Search ..... 345/60–72; 313/586–587; 445/24
See application file for complete search history.

(56) References Cited

U.S. PATENT DOCUMENTS 5,909,083 A * 6/1999 Asano et al. ..... 445/24
2005/0110408 A1 5/2005 Jang et al.
2005/0159070 A1* 7/2005 Banba et al. ..... 313/582
2005/0277354 A1* 12/2005 Buzoujima et al. ..... 313/582

FOREIGN PATENT DOCUMENTS

JP 2001-006536 1/2001
JP 2003-100205 4/2003
JP 2004-148585 5/2004
KR 10- 2004-0101917 A 12/2004
WO WO2004/107379 12/2004

* cited by examiner

*Primary Examiner*—David L Lewis
(74) *Attorney, Agent, or Firm*—KED & Associates LLP

(57) ABSTRACT

A dielectric sheet having two layers made of different materials for forming a differential dielectric sheet on a plasma display panel, a plasma display panel using the same, and a manufacturing method therefor.

24 Claims, 9 Drawing Sheets

DIELECTRIC SHEET, PLASMA DISPLAY PANEL USING THE SAME, AND MANUFACTURING METHOD THEREFOR

This application claims the benefit of Korean Patent Application No. 10-2005-0061739, filed on Jul. 8, 2005, Korean Patent Application No. 10-2005-0072873, filed on Aug. 9, 2005, Korean Patent Application No. 10-2005-0135571, filed on Dec. 30, 2005, which is hereby incorporated by reference as if fully set forth herein.

BACKGROUND OF THE INVENTION

1. Field of the Invention

The present invention relates to a plasma display panel, and more particularly, to a plasma display panel, in which a differential dielectric is formed on an upper plate to reduce breakdown voltage and discharge current, and a method for manufacturing the same.

2. Discussion of the Related Art

Generally, in a plasma display panel, discharge cells are divided from each other by barrier ribs formed between a front substrate and a rear substrate. Each of the discharge cells is filled with a main discharge gas, such as neon gas, helium gas, or neon-helium mixed gas, and an inactive gas containing a small amount of xenon. When an electric discharge occurs by means of a high-frequency voltage, the inactive gas generates vacuum ultraviolet rays, and the vacuum ultraviolet rays cause fluorescent materials between the barrier ribs to emit light, thereby forming an image. The above-described plasma display panel has a small thickness and a light weight, thus being spotlighted as the next generation display device.

FIG. 1 is a schematic perspective view of a conventional plasma display panel. As shown in FIG. 1, a plurality of pairs of retaining electrodes, each of which includes a scan electrode 102 and a sustain electrode 103, are arranged on a front glass 101, serving as a display plane, on which an image is displayed, of a front substrate 100 of the plasma display panel. A plurality of address electrodes 113 are arranged on a rear glass 111 of a rear substrate 110 in such a manner that the address electrodes 113 intersect the pairs of the retaining electrodes. The rear substrate 110 is connected to the front substrate 100 in parallel under the condition that the rear substrate 110 and the front substrate 100 are spaced from each other by a designated distance.

Barrier ribs 112 formed in a stripe type (or a well type) for forming a plurality of discharge spaces, i.e., discharge cells, are arranged in parallel on the rear substrate 110. Further, a plurality of the address electrodes 113 for performing address discharge to generate vacuum ultraviolet rays are arranged in parallel with the barrier ribs 112. R, G, B fluorescent materials 114 for emitting visible rays to display an image when the address discharge occurs are applied to the upper surface of the rear substrate 110. A lower dielectric layer 115 for protecting the address electrodes 113 is formed between the address electrodes 113 and R, G, B fluorescent materials 114.

The above conventional plasma display panel is manufactured through a glass-manufacturing process, a front substrate-manufacturing process, a rear substrate-manufacturing process, and an assembling process.

First, the front substrate-manufacturing process includes forming scan electrodes and sustain electrodes on a front glass, forming an upper dielectric layer for limiting discharge current of the scan and sustain electrodes and insulating pairs of the scan and sustain electrodes from each other, and forming a protection layer on the upper dielectric by depositing magnesium oxide for facilitating the discharge condition The rear substrate-manufacturing process includes forming address electrodes on a rear glass, forming a lower dielectric layer for protecting the address electrodes, forming barrier ribs on the upper surface of the lower dielectric layer for dividing discharge cells from each other, and forming a fluorescent material layer on regions between the barrier ribs for emitting visible rays.

The above plasma display panel and the method for manufacturing the same have problems, as follows.

In order to improve the light-emitting efficiency of the plasma display panel, it is necessary to reduce discharge current. The discharge current is influenced by the thickness of the dielectric layer. Generally, when the dielectric layer has a small thickness, breakdown voltage is decreased and discharge current is increased, and when the dielectric layer has a large thickness, the breakdown voltage is increased and the discharge current is decreased. Accordingly, when the thickness of the dielectric layer is simply increased, the discharge current is decreased, but the breakdown voltage is increased.

In order to solve the above problem, the formation of a differential dielectric layer having different thicknesses according to regions on the upper plate has been proposed. That is, grooves or protrusions are formed on the dielectric layer, thus improving the discharge efficiency of the plasma display panel and reducing power consumption.

The formation of the differential dielectric layer is achieved by a screen printing method or a sanding method.

The screen printing method has a simple process and requires low-priced equipment, but deteriorates the uniformity of the thickness and the width of a layer to be formed, thus lowering the accuracy of a fine definition pattern. Further, the screen printing method leaves mesh marks of a screen mask even after a baking process, thus lowering a surface roughness. Particularly, in a large-sized panel, the screen printing method deforms the screen mask, thus causing disagreement of patterns.

The sanding method is a method in that a dielectric layer is selectively cut using kinetic energy of cutting particles, such as ceramic particles or ultrafine particles of calcium carbonate through a mask patterned on the dielectric layer, thus forming a differential dielectric. The sanding method is capable of produce the differential dielectric having a line width of less than 50 μm. However, the sanding method causes environmental contamination due to dust, and cracks in a fine-definition pattern due to the crushing energy of the cutting particles.

SUMMARY OF THE INVENTION

Accordingly, the present invention is directed to a dielectric sheet, a plasma display panel using the same, and a manufacturing method therefor.

One object of the present invention is to provide a dielectric sheet having a double-layered structure, a plasma display panel using the same, and a manufacturing method therefor.

To achieve this object and other advantages and in accordance with the purpose of the invention, as embodied and broadly described herein, a dielectric sheet includes a first layer including a photosensitive material; and a second layer including a nonphotosensitive material.

In a further aspect of the present invention, a plasma display panel includes an upper plate provided with a dielectric comprising a first layer including a photosensitive material and a second layer including a nonphotosensitive material; and a lower plate provided with barrier ribs.

In another aspect of the present invention, a method for manufacturing a plasma display panel includes forming a dielectric sheet comprising at least one layer including a photosensitive material, on an upper glass provided with pairs of retaining electrodes; and exposing the dielectric sheet to light, and developing the dielectric sheet.

In another aspect of the present invention, a dielectric sheet includes a first layer, which dissolves in a developing solution; and a second layer, which does not dissolve in the developing solution.

In another aspect of the present invention, a plasma display panel includes an upper plate provided with a dielectric comprising a first layer, which dissolves in a developing solution, and a second layer, which does not dissolve in the developing solution; and a lower plate provided with barrier ribs.

In another aspect of the present invention, a method for manufacturing a plasma display panel includes forming a dielectric sheet, comprising a photoresist layer and a layer made of a material, which dissolves in a developing solution, on an upper glass provided with pairs of retaining electrodes; and exposing the dielectric sheet to light, and developing the dielectric sheet.

In another aspect of the present invention, a dielectric sheet includes a base film; a light-heat conversion layer formed on the base film for absorbing light and generating heat; and a dielectric material layer formed on the light-heat conversion layer.

In yet another aspect of the present invention, a method for manufacturing a plasma display panel includes forming a first dielectric on an upper glass provided with pairs of retaining electrodes; mounting a dielectric sheet comprising a base film, a light-heat conversion layer, and a dielectric material layer on the first dielectric; and forming a second dielectric by irradiating light onto the dielectric sheet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A dielectric sheet of the present invention has at least two layers made of materials having different properties, and a differential dielectric of a plasma display panel is formed using the dielectric sheet.

Figure 1:
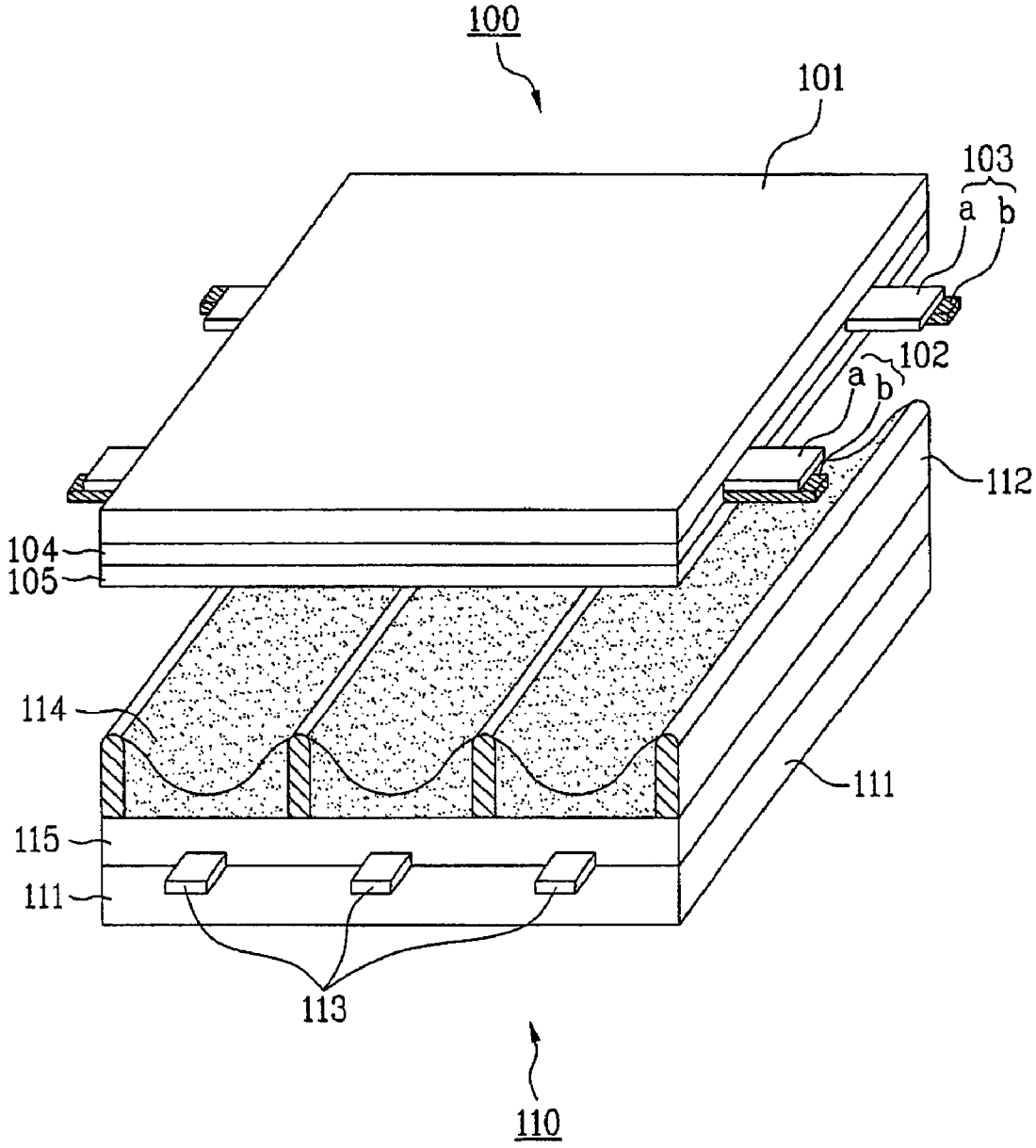
FIG. 1 is a schematic perspective view of a conventional plasma display panel.
Figure 2:
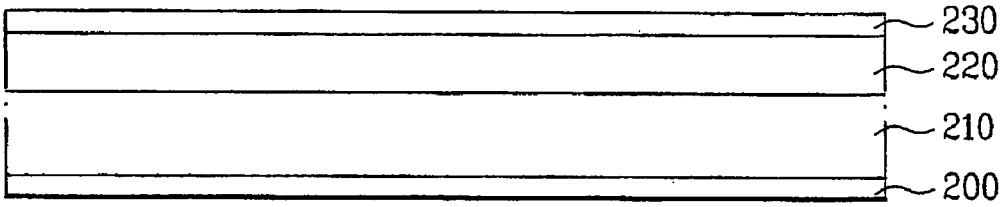
FIG. 2 is a sectional view of a dielectric sheet in accordance with a first embodiment of the present invention.

FIG. 2 is a sectional view of a dielectric sheet in accordance with a first embodiment of the present invention. Hereinafter, with reference to FIG. 2, the dielectric sheet in accordance with the first embodiment will be described.

The dielectric sheet of the first embodiment comprises a first film 200, a first layer 210, a second layer 220, and a second film 230. The first film 200 and the second film 230 are used in a process for manufacturing and carrying the dielectric sheet, and the first layer 210 and the second layer 220 are substantially used to form a differential dielectric of a plasma display panel. Preferably, the first layer 210 includes a photosensitive material, and the second layer 220 includes a nonphotosensitive material.

FIGS. 3A to 3E are sectional views illustrating a plasma display panel and a method for manufacturing the same in accordance with the first embodiment of the present invention. Hereinafter, with reference to FIGS. 3A to 3E, the plasma display panel and the method for manufacturing the same in accordance with the first embodiment will be described.

Figure 3A:
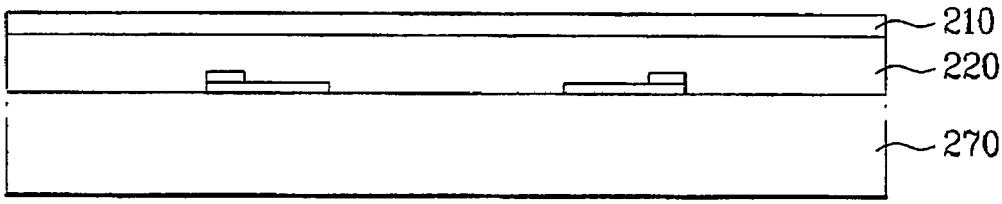
FIGS. 3A to 3E are sectional views illustrating a plasma display panel and a method for manufacturing the same in accordance with the first embodiment of the present invention.

First, as shown in FIG. 3A, a dielectric sheet is formed on an upper glass 270, on which pairs of retaining electrodes are provided, by laminating. As described above, the dielectric sheet comprises the first layer 210 containing the photosensitive material, and the second layer 220 containing the nonphotosensitive material. That is, FIG. 3A illustrates the dielectric sheet of the first embodiment, from which the first film 200 and the second film 230 are removed, formed on the upper glass 270. Preferably, in order to increase the compression strength between the dielectric sheet and the upper glass 270, the dielectric sheet is compressed onto the upper glass 270 using a roller.

Thereafter, as shown in FIG. 3B to 3E, a differential dielectric is formed by an exposing process.

Figure 3B:
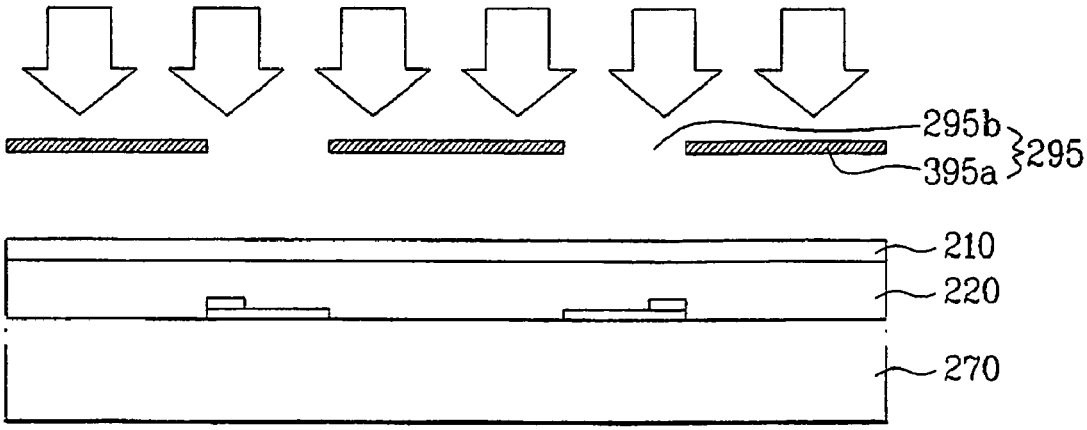

FIG. 3B illustrate the exposing process, in which ultraviolet rays are irradiated onto the dielectric sheet provided on the upper glass 270. Here, a mask 295 is interposed between a light source and the upper glass 270, and the light source irradiates the ultraviolet rays onto the upper glass 270, thus forming the differential dielectric. Specifically, the mask 295 has light shielding portion 295*a* and light transmitting portion 295*b*. Only the light transmitting portions 295*b* transmit the ultraviolet rays so that the ultraviolet rays are irradiated onto the dielectric sheet under the light transmitting portions 295*b*.

Figure 3C:
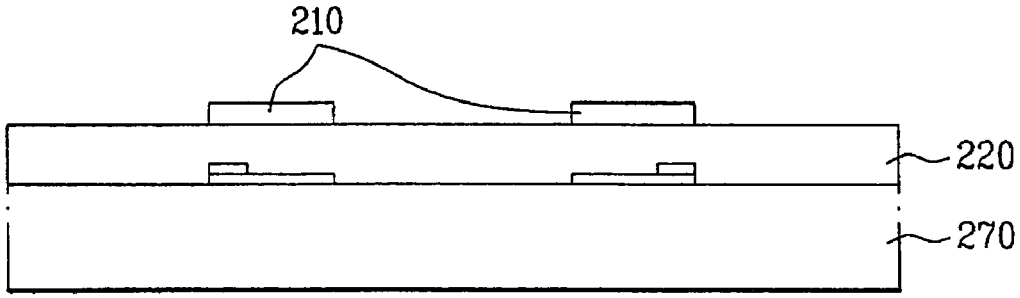

In FIG. 3B, the ultraviolet rays are irradiated only onto the dielectric sheet provided with the pairs of the retaining electrodes, thus forming the differential dielectric, as shown in FIG. 3C. Accordingly, only portions of the first layer 210 including the photosensitive material, onto which the ultraviolet rays are irradiated, remain after developing and baking processes. That is, as shown in FIG. 3C, the differential dielectric having a differential thickness is formed. Specifically, the thickness of the differential dielectric at portions with the pairs of the retaining electrodes is larger than the thickness of the differential dielectric at other portions. Accordingly, the thickness of the dielectric on the upper glass is selectively reduced, thus increasing the permittivity. This causes the decrease of the discharge voltage.

Figure 3D:
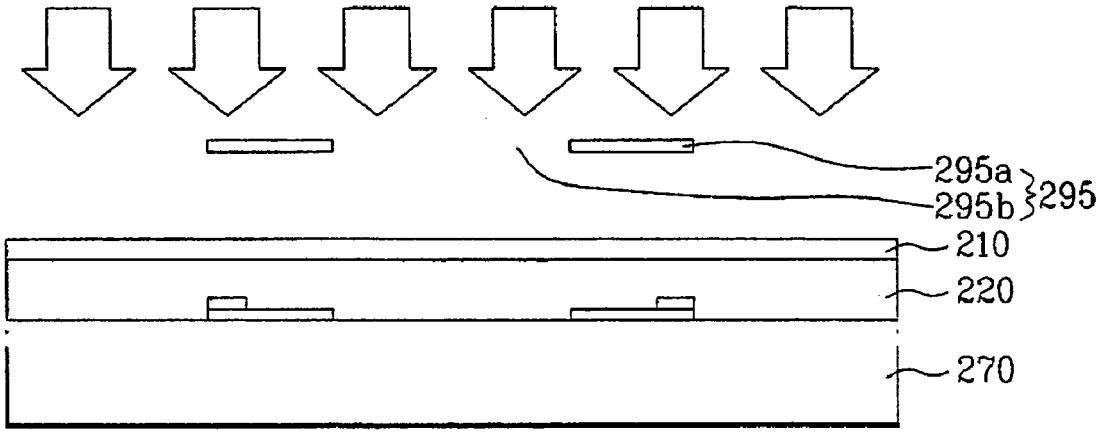
Figure 3E:
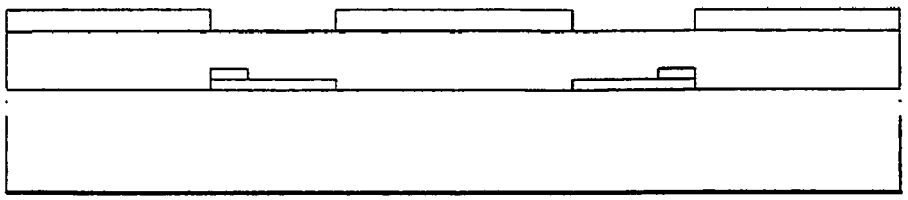

In FIG. 3D, the positions of the light shielding portions 295*a* and the positions of the light transmitting portions 295*b* are exchanged. That is, the ultraviolet rays are irradiated onto only portions of the dielectric sheet, in which the pairs of the retaining electrodes are not provided, and the dielectric sheet forms the differential dielectric by the developing and baking processes. Thereafter, as shown in FIG. 3E, the differential dielectric, in which the thickness of the differential dielectric at portions without the pairs of the retaining electrodes is larger than the thickness of the differential dielectric at other portions, is formed, thereby increasing a discharge path and improving a discharge efficiency.

The plasma display panel in accordance with the first embodiment is characterized in that the dielectric layer comprises two layers respectively containing a photosensitive material and a nonphotosensitive material and the thickness of the layer containing the photosensitive material is not uniform.

Figure 4:
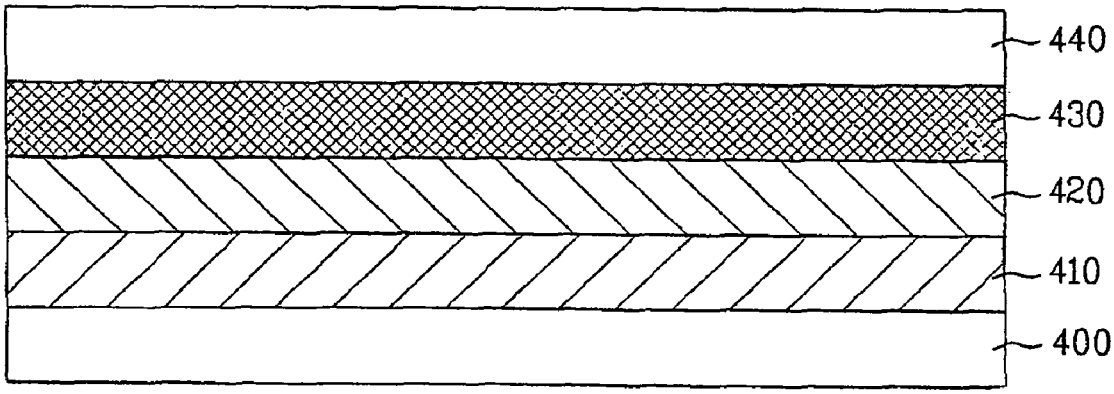
FIG. 4 is a sectional view of a dielectric sheet in accordance with a second embodiment of the present invention.

FIG. 4 is a sectional view of a dielectric sheet in accordance with a second embodiment of the present invention. Hereinafter, with reference to FIG. 4, the dielectric sheet in accordance with the second embodiment will be described.

The dielectric sheet of the second embodiment comprises a first film 400, a second layer 410, a first layer 420, a photoresist layer 430, and a second film 440, which are sequentially provided. The first layer 220 and the second layer 410 are used to manufacture a dielectric, and thus contain dielectric powder, a dispersant, and a plasticizer. Preferably, the first layer 420 further contains a material, which dissolves in a developing solution, and the second layer 410 further contains a material, which does not dissolve in the developing solution. The material, which dissolves in the developing solution, is preferably a polymeric organic matter, and more preferably an acrylic organic matter. Preferably, the developing solution is water or an alkaline water solution. The photoresist layer 430, which is formed on the first layer 420, is used to selectively develop the first layer 420 through exposing and developing processes in a method for manufacturing a plasma display panel, which will be described later. The first film 400 and the second film 440 are made of Polyethylene terephthalate (PET).

FIGS. 5A to 5E are sectional views illustrating a plasma display panel and a method for manufacturing the same in accordance with the second embodiment of the present invention. Hereinafter, with reference to FIGS. 5A to 5E, the plasma display panel and the method for manufacturing the same in accordance with the second embodiment will be described.

Figure 5A:
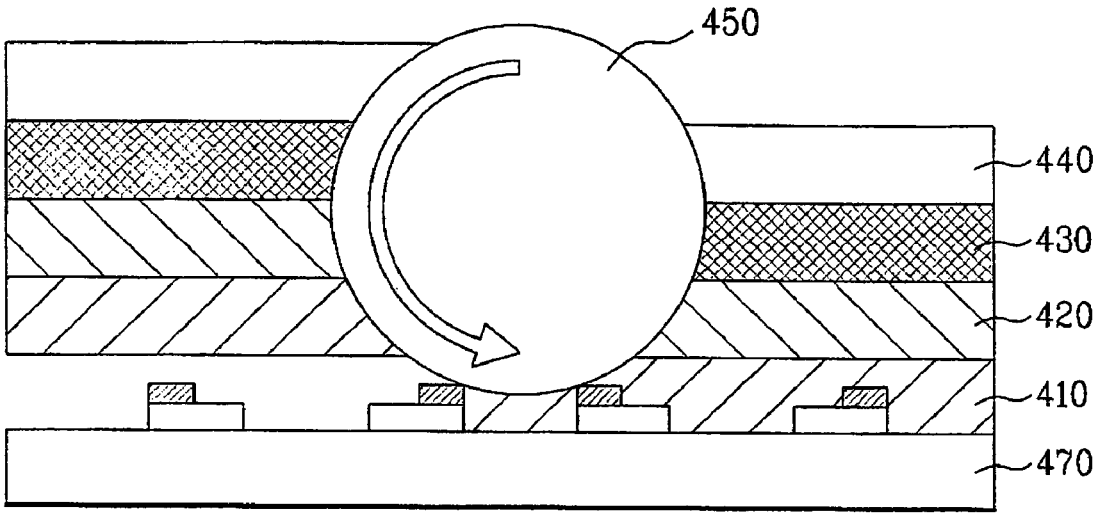
FIGS. 5A to 5E are sectional views illustrating a plasma display panel and a method for manufacturing the same in accordance with the second embodiment of the present invention.
Figure 5B:
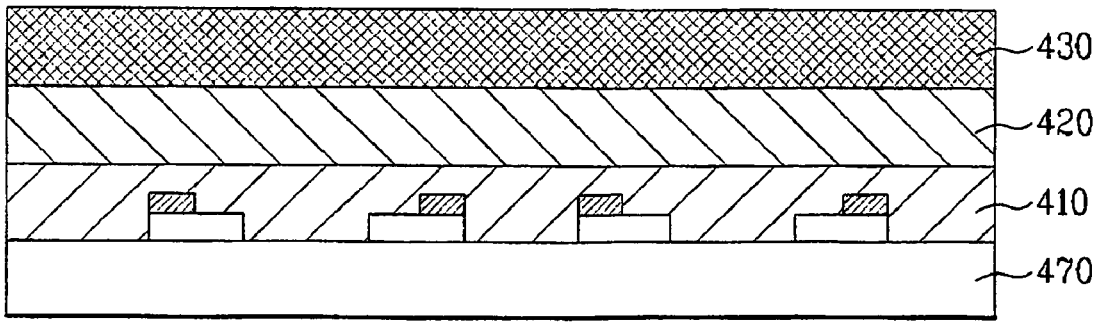

In this method, a differential dielectric is formed on the plasma display panel using the above dielectric sheet of the second embodiment. First, as shown in FIG. 5A, the dielectric sheet is formed on an upper glass 470, on which pairs of retaining electrodes are provided. Preferably, the dielectric sheet is formed on the upper glass 470 by laminating. Here, after the first film 400 is removed from the dielectric sheet, the dielectric sheet is laminated on the upper glass 470 using a roller 450. Thereafter, as shown in FIG. 5B, the second film 440 is removed from the dielectric sheet.

Figure 5C:
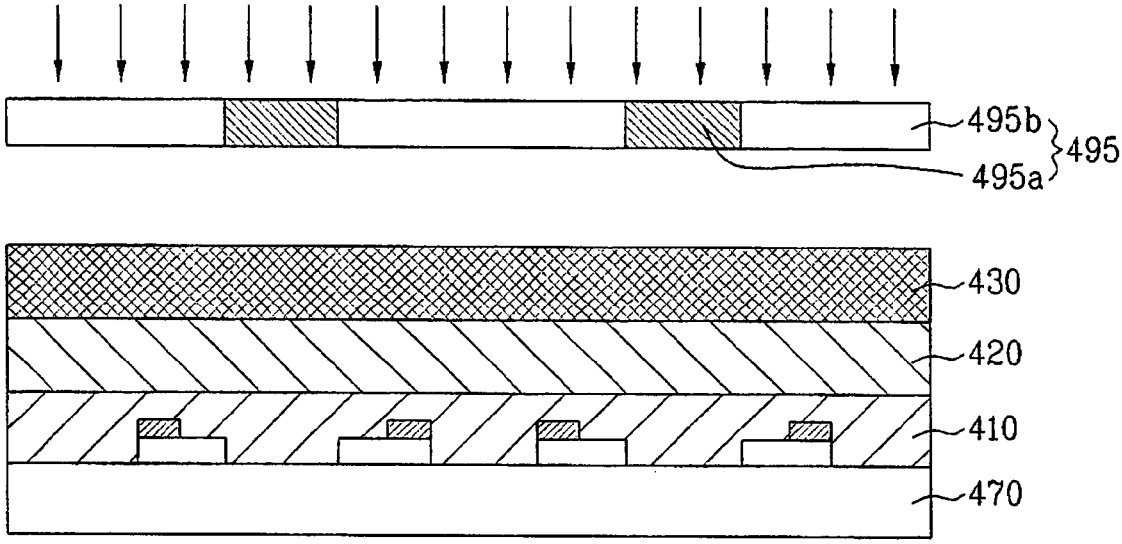
Figure 5D:
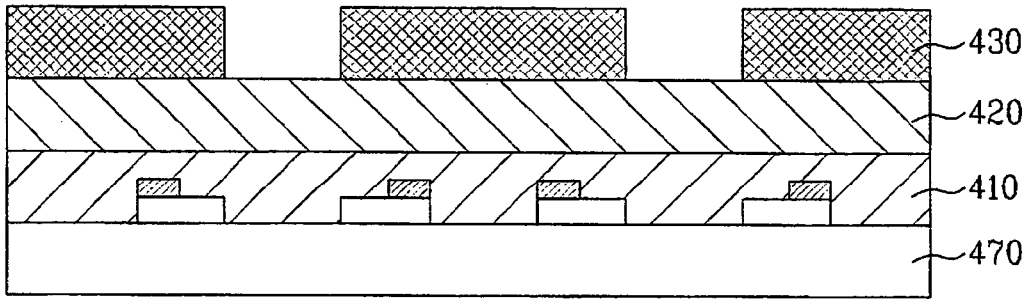

Thereafter, as shown in FIG. 5C, an exposing process is performed. Preferably, ultraviolet rays are irradiated onto the dielectric sheet. Here, a mask 495 having light shielding portions 495*a* and light transmitting portions 485*b* is coated on the dielectric sheet so that the ultraviolet rays are irradiated selectively onto the photoresist layer 430. Preferably, the photoresist layer 430 is made of a negative-type photosensitive organic matter. In this embodiment, the light transmitting portions 495*b* are provided on nondischarge portions outside the pairs of the retaining electrodes. Accordingly, after the ultraviolet rays are irradiated onto the dielectric sheet, the photoresist layer 430 having a designated pattern, as shown in FIG. 5D, is formed by a developing process.

Figure 5E:
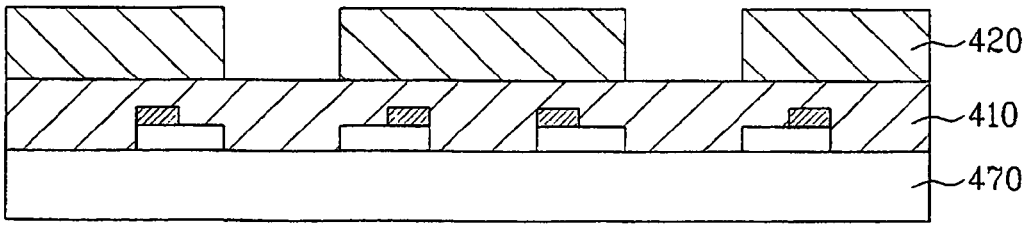

Thereafter, after the dielectric sheet is developed, the dielectric sheet is baked, thus forming a differential dielectric, as shown in FIG. 5E. Preferably, only the first layer 420 is developed using water or an alkali solution as a developing solution.

A protection layer made of magnesium oxide is formed on the above differential dielectric by CVD or ion plating. Thereby, the manufacture of an upper plate of the plasma display panel is completed. The above method shortens a time to form the differential dielectric, simplifies a process for forming the differential dielectric, and improves the uniformity of the thickness of the dielectric layer.

In the plasma display panel manufactured by the above method, the differential dielectric having the first layer, which dissolves in the developing solution, and the second layer, which does not dissolve in the developing solution, is formed on the upper plate. The first layer has a differential thickness, thus forming the differential dielectric.

Figure 6:
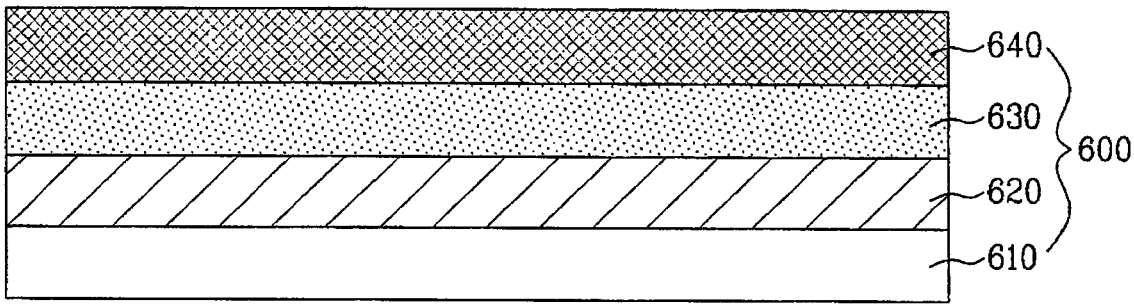
FIG. 6 is a sectional view of a dielectric sheet in accordance with a third embodiment of the present invention.

FIG. 6 is a sectional view of a dielectric sheet in accordance with a third embodiment of the present invention. Hereinafter, with reference to FIG. 6, the dielectric sheet in accordance with the third embodiment will be described.

The dielectric sheet 600 of the third embodiment comprises a base film 610, a light-heat conversion layer 620, and a dielectric material layer 640, which are sequentially provided. Preferably, an emission layer 630 is formed between the light-heat conversion layer 620 and the dielectric material layer 640.

When a laser beam is irradiated onto the dielectric sheet of this embodiment, light energy of the laser beam is converted into heat energy by the light-heat conversion layer 620, and the dielectric material layer 640 is selectively transcribed by the heat energy, thus forming a differential dielectric. Hereinafter, the composition of the dielectric sheet is described in detail.

The base film 610 is made of a material, which transmits light, preferably, a laser beam. More preferably, the base film 610 is made of a transparent polymer. The polymer is one selected from the group consisting of polyester, such as PET, polyacryl, polyepoxy, polyethylene, and polystyrene. Most preferably, the base film 610 is made of PET. Further, preferably, the base film 610 has a thickness of 10~500 μm. Since the base film 610 supports the dielectric sheet 600, the base film 610 may be made of a polymeric composite. However, in order to prevent the base film 610 from being decomposed by the heat generated from the light-heat conversion layer 620, the base film 610 is preferably made of a material having a high decomposition temperature.

Preferably, the light-heat conversion layer 620 is made of a light absorption material, which absorbs a light energy source. More preferably, the light-heat conversion layer 60 is made of at least one selected from the group consisting of metals, metal oxides, and metal sulfides, or made of an organic matter including at least one selected from the group consisting of carbon black, graphite, and laser beam absorption materials.

The metals include aluminum, silver, chrome, tin, nickel, titanium, cobalt, zinc, gold, cupper, tungsten, molybdenum, lead, and their alloys. Preferably, aluminum, silver, and their alloy are used.

Preferably, an infrared pigment is added to the organic matter. More preferably, the organic matter includes a polymeric bonding resin, and a coloring agent, such as a pigment and/or a dye, and a dispersant, which are dispersed in the polymeric bonding resin. The polymeric bonding resin may independently use (meta)acrylate oligomer, such as acryl (meta)acrylate oligomer, ester(meta)acrylate oligomer, epoxy(meta)acrylate oligomer, or urethane(meta)acrylate oligomer. Further, the polymeric bonding resin may use a mixture of (meta)acrylate oligomer and (meta)acrylate monomer, or independently use (meta)acrylate monomer. Preferably, carbon black and graphite have a particle diameter of less than 0.5 μm, and an optical concentration of 0.1~4.

The dielectric material layer 640 is made of a material of the conventional dielectric layer, and uses $PbO—B_2O_3—SiO_2$-based, $ZnO—B_2O_3—SiO_2$-based, or $PbO—SiO_2—Al_2O_3$-based glass particles. Preferably, the dielectric material layer 640 includes a binder, which is decomposed by the heat generated from the light-heat conversion layer 620. Further, the binder has a decomposition temperature ($T_d$), which is preferably lower than that of the base film 610, and more preferably less than 350° C.

Preferably, the binder includes at least one selected from the group consisting of polypropylene carbonate, poly(alpha-methyl)styrene, polymethyl methacrylate, polybutyl methacrylate, cellulose acetate butyrate, nitrocellulose, polyvinyl chloride, poly(chlorovinyl)chloride, polyacetal polyurethane, polyester, polyacrylonitrile, maleic acid resin, and their copolymers.

Further, a photoresist may be used as the binder. The binder is preferably a film, and more preferably a film, which can be coated with a solution or a dispersion solution. In order to exhibit a transcribing effect, which will be described later, more preferably, a binder, which has a melting point of below approximately 250° C., or is plasticized at a glass transition temperature of below 70° C., is used. A binder, which is easily liquefied or thermally melted, for example, a low-melting wax, is used as a common binder for lowering the melting point of a texture. However, when the above binder has low flowability and durability, the binder is not used independently.

Preferably, the emission layer 630 includes a material for increasing transcribing ability so that the dielectric material layer 640 can be more effectively transcribed. That is, in order to provide pressure required to emit exposed regions, the emission layer 630 includes a foaming agent, which causes a decomposition reaction to emit nitrogen gas or hydrogen gas when it absorbs light or heat. For example, the foaming agent is pentaerythritol tetranitrate (PETN) or trinitrotoluene (TNT).

FIGS. 7A to 7D are sectional views illustrating a plasma display panel and a method for manufacturing the same in accordance with the third embodiment of the present invention. Hereinafter, with reference to FIGS. 7A to 7D, the plasma display panel and the method for manufacturing the same in accordance with the third embodiment will be described.

Figure 7A:
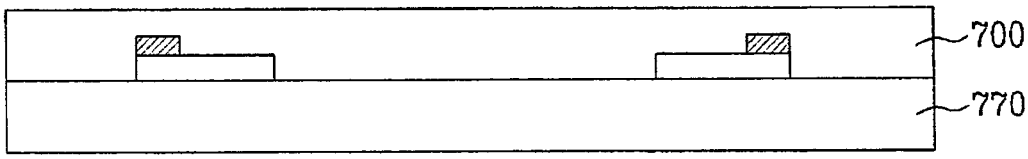
FIGS. 7A to 7D are sectional views illustrating a plasma display panel and a method for manufacturing the same in accordance with the third embodiment of the present invention.

In this method, a differential dielectric is formed on the plasma display panel using the above dielectric sheet of the third embodiment. First, as shown in FIG. 7A, a first dielectric 700 is formed on an upper glass 770, on which pairs of retaining electrodes are provided. The first dielectric 700 is formed on the upper glass 770 by one conventional method, such as a printing, green sheet, or coating method.

Figure 7B:
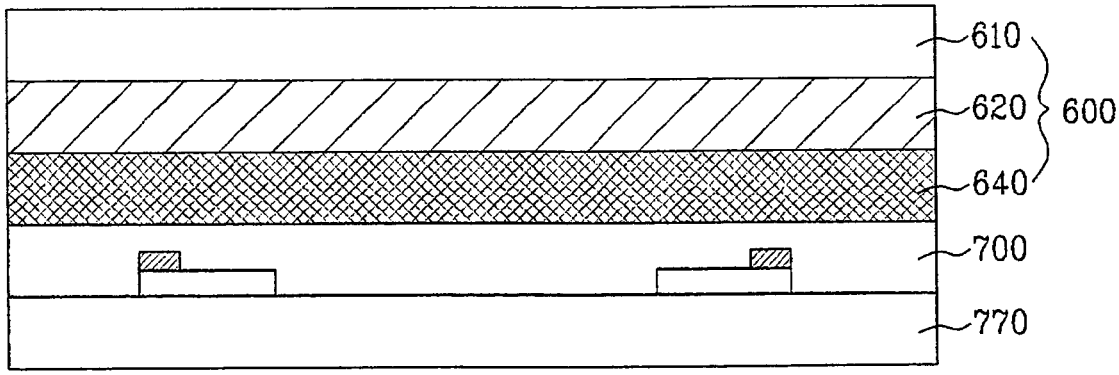

Thereafter, as shown in FIG. 7B, the dielectric sheet 600 comprising the base film 610, the light-heat conversion layer 620, and the dielectric material layer 640 is mounted on the first dielectric 700. Preferably, the dielectric sheet 600 further comprises the emission layer 630, as shown in FIG. 6. However, in FIG. 7B, the dielectric sheet 600 is mounted on the first dielectric 700 under the condition that the dielectric sheet 600 of FIG. 6 is upside down.

Figure 7C:
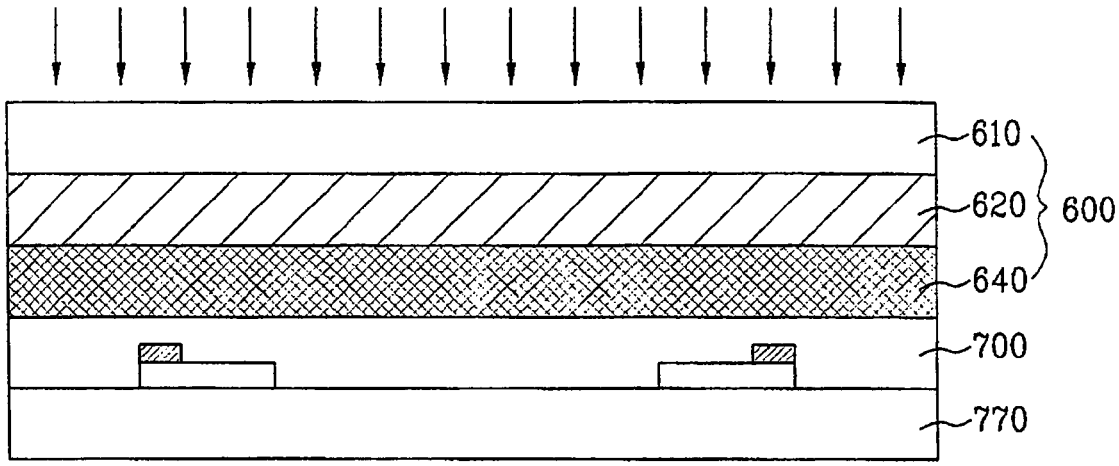

Thereafter, as shown in FIG. 7C, light is irradiated onto the dielectric sheet 600, thus forming a second dielectric. A laser, a xenon lamp, or a flash lamp is used as a light source. Among the above light sources, the laser exhibits the most excellent transcribing effect. All general lasers including spherical, gas, semiconductor, and dye lasers may be used. Preferably, an Nd:YAG laser is used. Here, the method of this embodiment irradiates a laser beam selectively onto the dielectric sheet 600 without a separate photo mask, and does not require the conventional developing process. However, the method does not exclude the photo mask and the developing process.

When the laser beam is irradiated, the laser beam passes through the base film 610, activates the light-heat conversion layer 620, and emits heat due to pyrolysis. The emitted heat melts or decomposes the binder of the dielectric material layer 640, and causes the decomposition reaction in the emission layer 630. Then, the emission layer 630 is expanded, and the dielectric material layer 640 is separated from the dielectric sheet 600 and is transcribed onto the first dielectric 700.

Figure 7D:
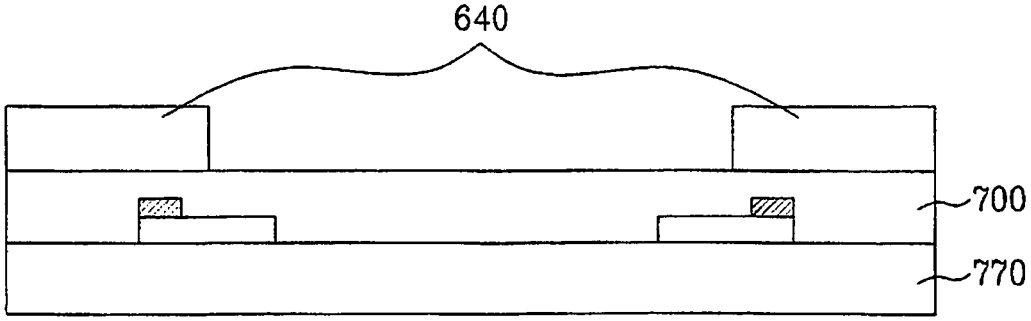

Thereafter, when the dielectric sheet 600 is separated from the first dielectric 700, since portions of the dielectric material layer 640, onto which the laser beam is not irradiated, are bonded to the light-heat conversion layer 620, the portions of the dielectric material layer 640 are separated from the first dielectric 700. Accordingly, portions of the dielectric material layer 640, onto which the laser beam is irradiated, are transcribed onto the first dielectric 700, and form a differential dielectric, as shown in FIG. 7D, by a baking process.

The method of the third embodiment does not use an expensive photo mask and does not requires the developing process, thus reducing the production costs of plasma display panels and allowing mass production of large-sized plasma display panels.

Processes forming other parts except for the process forming the upper dielectric in the above methods in accordance with the embodiments of the present invention are the same as those in the conventional method.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dielectric sheet for a plasma display panel, comprising:

a first film;

a second layer over the first film;

a first layer over the second layer;

a photoresist layer over the first layer; and a second film over the photoresist layer, wherein the first layer and the photoresist layer are able to dissolve in a same developing solution.

2. The dielectric sheet according to claim 1, wherein the first layer includes dielectric powder, a dispersant, a plasticizer, and a polymeric organic matter, which dissolves in the developing solution.

3. The dielectric sheet according to claim 2, wherein the polymeric organic matter is an acrylic organic matter.

4. The dielectric sheet according to claim 1, wherein the second layer includes dielectric powder, a dispersant, a plasticizer, and a polymeric organic matter, which does not dissolve in the developing solution.

5. The dielectric sheet according to claim 1, wherein the developing solution is water or an alkaline water solution.

6. A method for manufacturing a plasma display panel comprising:

forming a dielectric sheet over an upper glass provided with pairs of retaining electrodes; and exposing the dielectric sheet to light, and developing the dielectric sheet, wherein the dielectric sheet comprises:

a second layer over the upper glass;

a first layer over the second layer; and a photoresist layer over the first layer, wherein the first layer and the photoresist layer dissolve in a same developing solution.

7. The method according to claim 6, wherein:

the developing solution is water or an alkaline water solution; and the second layer is made of a material which does not dissolve in water or the alkaline water solution.

8. A dielectric sheet for a plasma display panel comprising:

a base film;

a light-heat conversion layer formed on the base film; and a dielectric material layer formed on the light-heat conversion layer, wherein the light-heat conversion layer contains a metal material for absorbing light and generating heat.

9. The dielectric sheet according to claim 8, further comprising an emission layer provided between the light-heat conversion layer and the dielectric material layer.

10. The dielectric sheet according to claim 9, wherein the emission layer includes a foaming agent, which is decomposed by the heat generated from the light-heat conversion layer and generates gas.

11. The dielectric sheet according to claim 8, wherein the base film transmits light.

12. The dielectric sheet according to claim 8, wherein the light-heat conversion layer includes at least one selected from the group consisting of metals, metal oxides, and metal sulfides.

13. The dielectric sheet according to claim 8, wherein the light-heat conversion layer includes an organic matter including at least one selected from the group consisting of carbon black, graphite, and laser beam absorption materials.

14. The dielectric sheet according to claim 8, wherein the dielectric material layer includes a binder, which is decomposed by the heat generated from the light-heat conversion layer.

15. The dielectric sheet according to claim 14, wherein the binder has a decomposition temperature lower than that of the base film.

16. The dielectric sheet according to claim 14, wherein the binder includes at least one selected from the group consisting of polypropylene carbonate, poly(alpha-methyl)styrene, polymethyl methacrylate, polybutyl methacrylate, cellulose acetate butyrate, nitrocellulose, polyvinyl chloride, poly (chlorovinyl)chloride, polyacetal polyurethane, polyester, polyacrylonitrile, maleic acid resin, and their copolymers.

17. The dielectric sheet according to claim 8, wherein the light is a laser beam.

18. A method for manufacturing a plasma display panel comprising:

forming a first dielectric on an upper glass provided with pairs of retaining electrodes;

mounting a dielectric sheet, comprising a base film, a light-heat conversion layer including a metal material for absorbing light and generating heat, and a dielectric material layer, on the first dielectric; and forming a second dielectric by irradiating light onto the dielectric sheet.

19. The method according to claim 18, wherein the formation of the second dielectric comprises:

transcribing portions of the dielectric material layer onto the first dielectric by selectively irradiating a laser beam onto the dielectric sheet;

separating the dielectric sheet from the first dielectric; and baking the portions of the dielectric material layer transcribed from the dielectric sheet onto the first dielectric.

20. The dielectric sheet according to claim 1, wherein the first and second layers contact one another to form a differential dielectric, the first layer having a first dielectric constant and the second layer having a second dielectric constant different from the first dielectric constant.

21. The dielectric sheet according to claim 20, one of the first or second layers is made from a photosensitive material and the other of the first or second dielectric layers is made from a non-photosensitive material.

22. The dielectric sheet according to claim 21, wherein one of the first or second dielectric layers is thicker than the other of the first or second dielectric layers.

23. The dielectric sheet according to claim 22, wherein one of the first or second dielectric layers is formed in a non-uniform pattern on the other of the first or second dielectric layers.

24. The dielectric sheet according to claim 23, wherein said one of the first or second dielectric layers include discrete portions formed in said non-uniform pattern on the other of the first or second dielectric layer, and wherein gaps are formed between respective pairs of the discrete portions.

* * * * *